US006023256A

United States Patent [19]

Ng et al.

[11] Patent Number: 6,023,256

[45] Date of Patent: Feb. 8, 2000

[54] LIQUID CRYSTAL DISPLAY DRIVER SYSTEM AND METHOD THEREFOR

[75] Inventors: Chung Yee Ricky Ng; Yiu Sang Lei; Ming Leung Lighten Tse; Hing Kau Stephen Cheung, all of Hong Kong, The Hong Kong Special Administrative Region of the People's Republic of China

[73] Assignee: Motorola, Inc., Schaumburg, Ill.

[21] Appl. No.: 08/856,617

[22] Filed: May 13, 1997

[30] Foreign Application Priority Data

May 15, 1996 [SG] Singapore ..... 9609809

[51] Int. Cl.[7] ..... G09G 3/18

[52] U.S. Cl. ..... 345/51; 345/52; 345/211

[58] Field of Search ..... 345/100, 204, 345/50, 52, 51, 211; 379/433; 340/825.44

[56] References Cited

U.S. PATENT DOCUMENTS

| | | | |
|---|---|---|---|
| 4,404,555 | 9/1983 | Long et al. | 340/784 |
| 4,740,786 | 4/1988 | Smith | 340/784 |
| 4,768,031 | 8/1988 | Mori et al. | 340/825.44 |
| 5,189,406 | 2/1993 | Humphries et al. | 340/793 |
| 5,387,922 | 2/1995 | Yun | 345/103 |
| 5,394,166 | 2/1995 | Shimada | 345/100 |
| 5,424,753 | 6/1995 | Kitagawa et al. | 345/94 |
| 5,434,690 | 7/1995 | Hisatake et al. | 359/87 |
| 5,450,619 | 9/1995 | Maeda | 379/433 |
| 5,543,781 | 8/1996 | Ganucheau, Jr. et al. | 340/825.44 |
| 5,796,391 | 8/1998 | Chiu et al. | 345/204 |
| 5,805,121 | 9/1998 | Burgan et al. | 345/50 |

FOREIGN PATENT DOCUMENTS

| | | | |
|---|---|---|---|
| 2229098 | 9/1990 | United Kingdom | A63F 3/02 |

*Primary Examiner*—Steven J. Saras
*Assistant Examiner*—Alecia D. Nelson
*Attorney, Agent, or Firm*—Rennie W. Dover

[57] ABSTRACT

An LCD Driver System (10) includes a row decoder (38) for providing command signals to row drivers (50) and a RAM row decoder (64) for controlling a RAM (76) which supplies data to a column driver (88). The row and column drivers (50 and 88) are supplied with power by a power source (58) which can supply either high or low voltages. In normal mode, the power source (58) supplies high voltage and the row driver (50) drives both a dot matrix portion (14) and an icon portion (16) of an LCD display. In an icon mode, a disable signal disables the row decoder (38) and the RAM row decoder (64), enables only the icon row driver (54) of the row drivers (50) and the icon row of the RAM (76) and switches the power source (58) to supply low voltage so as to save power.

3 Claims, 3 Drawing Sheets

LIQUID CRYSTAL DISPLAY DRIVER SYSTEM AND METHOD THEREFOR

FIELD OF THE INVENTION

This invention relates to a Liquid Crystal Display (LCD) Driver System and to a method for driving such a LCD system, and more particularly to a LCD Driver System for a portable, wireless communication device having a LCD with both an alphanumeric (or other character) dot matrix display portion and a symbol, or icon, display portion.

BACKGROUND OF THE INVENTION

Portable, wireless communication devices, such as pagers, mobile (cellular) telephones, Personal Digital Assistants (PDA's), etc., all have a requirement to consume as little power as possible since they are battery operated and it is desirable to extend the battery lifetime as far as possible before it requires replacement or recharging. Many such devices include a LCD having one portion which is used to display alphanumeric (or other) characters on a dot matrix display to provide changeable information to a user. Another portion of the LCD is used to display symbols, such as icons, which indicate the status of the device or other simple information to the user. The dot matrix display portion of the LCD generally requires relatively high voltage and consumes high power. The icon display portion requires relatively low voltage and consumes low power.

As more and more information is desired by users, more and more icons, or symbols are being displayed on the icon display portion, including, for example the date and/or time. However, to maintain low voltage use for the icon display portion would require an extra pin on the LCD driver chip for each extra icon, which is clearly undesirable, since it would increase chip size. Therefore, the icon display portion is generally connected as an extra line of display to the multiplexed lines of the dot matrix display portion. Thus, when the LCD is used to display information on the dot matrix display portion, as well as the icon display portion, the full (relatively high) voltage is required. When, however, only the icon display portion is required to be used, again the full voltage is necessary to power up the whole LCD, although the dot matrix display portion is kept clear of characters. Thus, even when the dot matrix display portion is not being utilized, it is still turned on and consumes power.

BRIEF SUMMARY OF THE INVENTION

The present invention therefore seeks to provide a LCD driver system and a method therefor which overcomes, or at least reduces the above-mentioned problems of the prior art.

Accordingly, the invention provides a LCD driver system for driving a LCD having a dot matrix display portion and an icon display portion, the LCD driver system comprising a LCD including a dot matrix display portion having a plurality of display rows and an icon display portion having at least one display row, a row driver coupled to the display rows of the LCD for driving the display rows, a voltage supply for selectively supplying either a higher or lower voltage level to the row driver, a row decoder coupled to the row driver for selectively enabling the display rows of the dot matrix display portion and of the icon display portion, a controller for providing a mode signal indicating either a normal mode of operation or an icon mode of operation, whereby the mode signal is coupled to the voltage supply for supplying the lower voltage level when the mode signal indicates the icon mode of operation and the higher voltage level when the mode signal indicates the normal mode of operation, the mode signal also being coupled to the row decoder for enabling the display rows of the dot matrix display portion when the mode signal indicates the normal mode of operation and disabling the display rows of the dot matrix display portion when the mode signal indicates the icon mode of operation, the display row of the icon display portion being enabled when the mode signal indicates the icon mode of operation and being selectively enabled by the row decoder when the mode signal indicates the normal mode of operation.

In a preferred embodiment, the LCD driver system further comprises a column driver coupled to display columns of the LCD for driving the display columns and to the voltage supply, a memory having a plurality of memory rows for storing a representation of information to be displayed on the dot matrix display portion and the icon display portion of the LCD, the memory being coupled to the column driver, a memory row decoder coupled to the memory for selectively enabling the memory rows of the memory, wherein the mode signal is coupled to the memory row decoder for enabling the memory rows storing the representation of information to be displayed on the dot matrix portion of the LCD when the mode signal indicates the normal mode of operation and disabling the memory rows storing the representation of information to be displayed on the dot matrix portion of the LCD when the mode signal indicates the icon mode of operation.

Preferably, during the icon mode of operation, the row driver outputs a square wave signal to the display row of the icon display portion of the LCD, the square wave signal having a lower level at a ground reference potential and a higher level at the lower voltage level, and a substantially static voltage signal to the display rows of the dot matrix display portion, the static voltage signal being at a level substantially halfway between the ground reference potential and the lower voltage level, and the column driver outputs a first square wave signal, in phase with the square wave signal output from the row driver, to the display columns of the LCD which are to remain blank, the first square wave signal from the column driver having a lower level at a ground reference potential and a higher level at the lower voltage level, and a second square wave signal, complementary to the first square wave signal, to the display columns of the LCD which are to be non-blank, the voltage difference between the column driver output signal and the row driver output signal controlling whether a particular pixel is blank or non-blank according to whether the voltage difference is higher than the threshold voltage required to activate the pixel, so that the display rows of the dot matrix display portion are disabled.

BRIEF DESCRIPTION OF THE DRAWINGS

One embodiment of the invention will now be more fully described, by way of example, with reference to the drawings, of which.

DETAILED DESCRIPTION OF THE DRAWINGS

Figure 1:
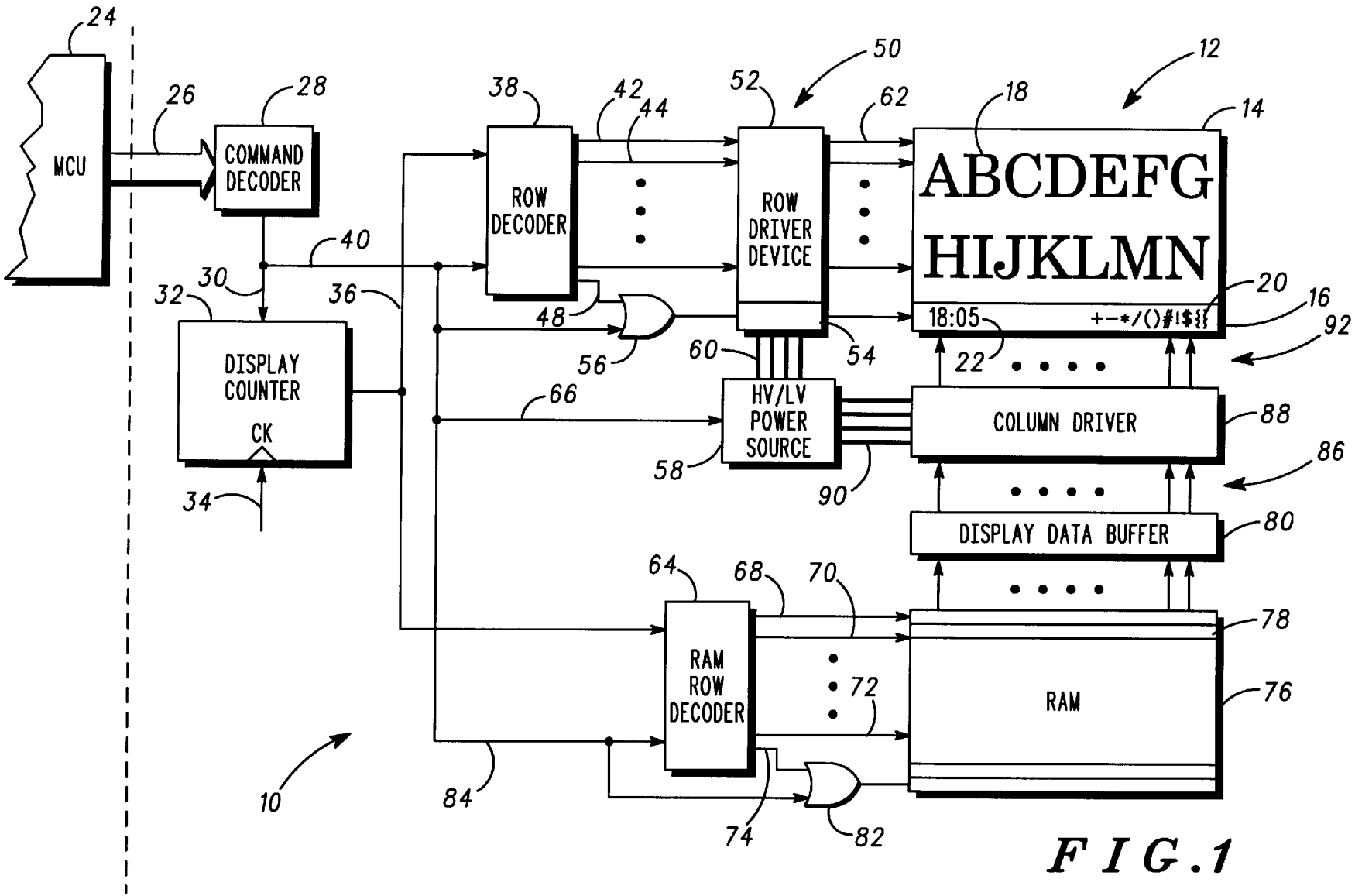
FIG. 1 shows a functional block diagram of an LCD driver system according to one embodiment of the invention.

Thus, as shown in FIG. 1, an LCD Driver System 10 is used to drive an LCD Panel 12 of a portable, wireless communication device. The LCD Panel 12 includes a dot matrix display panel portion 14 for displaying alphanumeric or other character messages 18 using a dot matrix and an icon display panel portion 16 for displaying icons 20 symbolizing particular pieces of information, for example whether the device is ON or OFF or whether it is morning AM or afternoon PM, and can include a time display 22.

To operate in the traditional high-multiplex mode, in which the icon display panel portion 16 and the dot matrix panel display portion 14 are both operational with the icon display panel portion 16 being treated as another line of the dot matrix display panel portion, a microcontroller unit (MCU) 24, used to control the driver system 10, sends a command to the driver system 10 to enter the high-multiplex mode. The command is sent via line 26 to a command decoder 28, which converts it to an enable signal (EN) at a logical low "0" voltage level. This enable signal EN is transferred via line 30 to a display counter 32 to enable the counter to count. The counter 32 is clocked by a display clock signal (CK) on line 34 and counts up from zero to a value corresponding to the number of display rows in the LCD panel 12, including both the dot matrix display portion 14 and the icon display portion 16. The count result from the counter 32 is binary coded on an output bus 36.

The output bus 36 is coupled to a row decoder 38, where the binary coded count result is decoded by the row decoder 38, which is also enabled by the enable signal EN transferred via line 40 from the command decoder 28 to the row decoder 38. The row decoder has a number of output lines 42, 44, 46 and 48 each coupled to a corresponding input of a row driver device 50, there being as many such output lines as there are rows in the LCD panel 12. The output of the row decoder 38 directly reflects the count result of the display counter 32, such that only 1 of the output lines 42, 44, 46 and 48 will be at a high logical "1" level, while all the others are at a low logical "0" level. This high logical "1" level signal is transferred, in sequence, to all the output lines 42, 44, 46 and 48 such that the hole LCD panel 12 is scanned. Thus, the high logical "1" level will first be put on the top output line 42 from the row decoder 38, followed by the second output line 44, and so on, down to the bottom output line 48 of the row decoder 38. The row driver device 50 includes a dot matrix row driver portion 52 having a row driver for each of the rows in the dot matrix display portion 14 of the LCD panel 12, which receives the output signals on output lines 42 to 46 corresponding to the dot matrix display rows, and an icon row driver portion 54, which receives the signal on output line 48 from the row decoder 38, via an OR logical gate 56. The enable signal EN is also coupled to a second input of the OR gate 56, whose output is input to the icon row driver portion 54 of the row driver device 50.

The row driver device 50 is powered from a power source 58 via row power lines 60 to output row-driving waveforms to the rows of the LCD panel 12 according to the output of the row decoder 38. The power source 58 is capable of providing either high voltage or low voltage on the row power lines 60 and the high voltage is selected by the enable signal EN from the command decoder 28 being received via line 66 from the command decoder 28. Over a complete scanning period, each of the rows will be selected separately, in turn, corresponding to the high logical "1" level, and the corresponding row driver will output an equivalent selected voltage level on an associated output line 62 to the equivalent display row of the LCD panel 12, while the other output lines 62 will output an unselected voltage level (corresponding to a low logical "0" level) to the LCD Panel 12.

The binary coded signal on the output bus 36 of the display counter 32 is also received by a RAM row decoder 64, where it is decoded and used to provide select signals over a plurality of RAM select lines 68, 70, 72 and 74 to a RAM 76 having a plurality of memory rows 78, each of which stores display bitmap data for each row of the LCD panel 12. Thus, similarly to the row drivers of the row driver device 50, one of the rows 78 of the RAM 76 is selected and enabled to be read by a display data buffer 80. This selecting and reading process will also start from the top row 78 of RAM 76 and finish at the bottom row, which stores display information for the Icon display portion 16 of the LCD panel 12. However, similarly to the bottom output line 48 of the row decoder 38, the bottom RAM select line 74 from the RAM row decoder 64 passes via an OR logical gate 82, whose other input receives the enable signal EN from the command decoder 28 via line 84, and whose output is passed to the bottom row of the RAM 76. The enable signal EN from the command decoder 28 on line 84 is also input to the RAM row decoder 64.

The display data buffer 80 has an output bus 86 connected to a column driver 88, which is also powered from the power source 58 via column power lines 90. The column driver 88 outputs either a voltage level to provide a blank pixel on the LCD panel 12 or a voltage level to provide a nonblank (black) pixel on the LCD panel 12 according to the data stored in the display data buffer 80 via column driver lines 92 to the LCD panel 12. Thus, a high logical "1" level stored in a bit of the display data buffer 80 will correspond to a nonblank voltage level, while a low logical "0" level will correspond to a blank voltage level.

Figure 3:
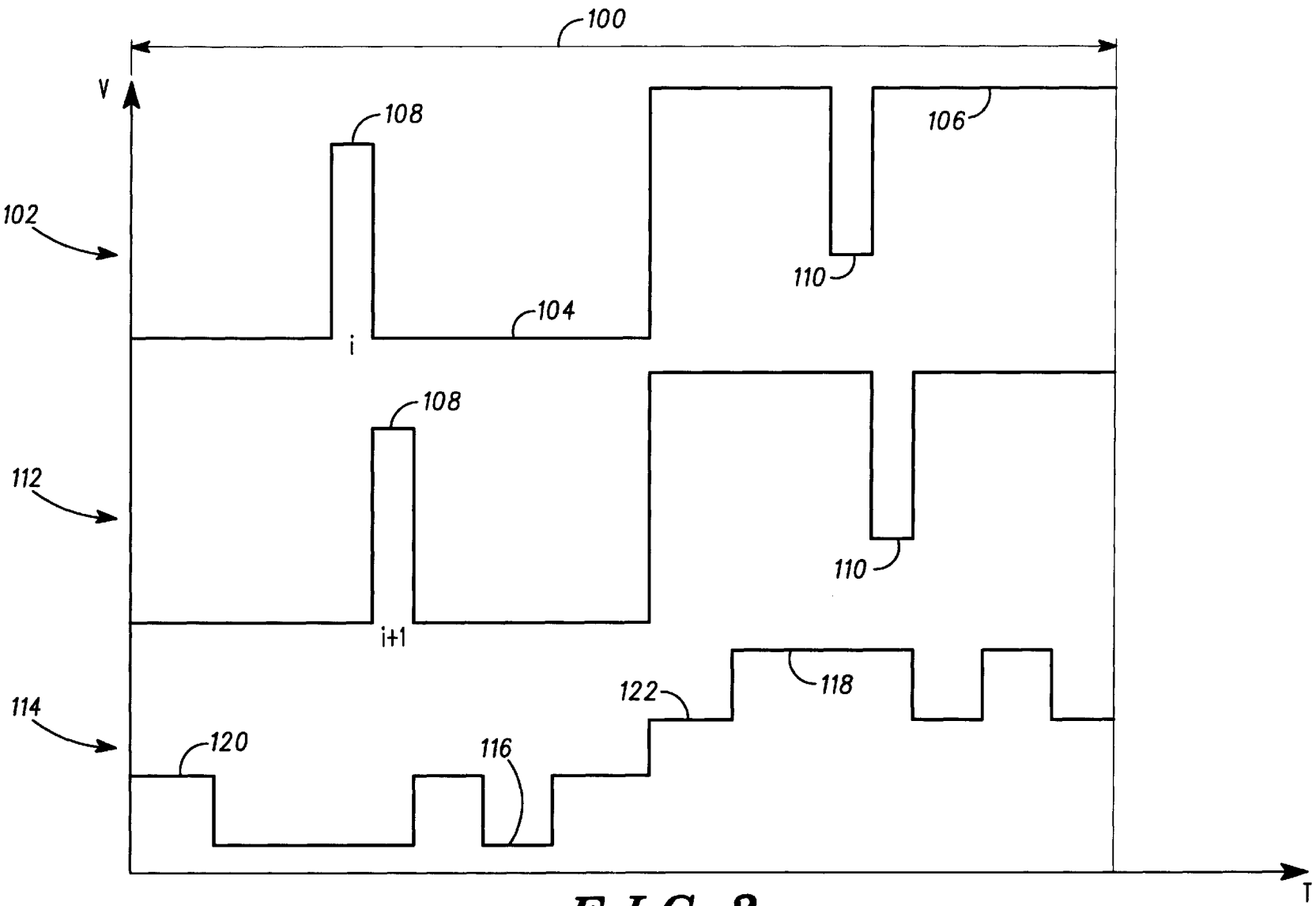
FIG. 3 is a waveform diagram showing the waveform set for both row and column drivers in a second mode of operation of the system of FIG. 1.

As best shown in FIG. 3, over a complete time frame 100 the waveforms, which are square wave in form, include one complete phase, so that they are symmetrical over the complete time frame. The output of row driver device 50 for row i of the LCD panel 12 is shown in diagram 102 as a function of voltage V against time T. As can be seen, the output remains at an unselected voltage level, which is either a low unselected level 104 or a high unselected level 106, depending on which half of the frame 100 we are in, except for a short period 1/N, where N is the total number of rows, when that row i has a selected voltage level, which is either high 108 or low 110. Similarly, as shown in diagram 112 for row I+1, the voltage is at the selected voltage level 108 or 110, only for the period 1/N when the row i+1 is selected, consecutively to row i.

The output voltage waveform from the column driver 88 is shown in diagram 114 of FIG. 3, where, again, the general waveform is a square wave varying over one complete phase over one time frame. The nonblank voltage level varies between a very low level 116 and a very high level 118, whereas the blank voltage level varies between a slightly low level 120 and a slightly high level 122.

A pixel on the LCD panel 12 will be nonblank if the power (which is proportional to the root-mean-square value of the voltage difference between the corresponding row and column voltage levels against time) on that pixel is greater than the threshold value of the LCD panel 12, which varies with different LCD panels. The pixel will be blank if the power is smaller than the threshold value. Therefore, the larger the number of rows required to be displayed on the LCD panel (i.e. the higher multiplexing required), the shorter the time for each row's pulse width (generally, each row's pulse width is just 1/N of the whole time frame), and therefore the smaller the power on each nonblank pixel.

So to make the power on each nonblank pixel larger than the threshold power of the LCD panel, a larger voltage difference between the selected voltage level and the nonblank voltage level is required, which means the power source 58 must output a relatively higher voltage through row power lines 60 to the row driver device 50 and through the column power lines 90 to the column driver 88 such that the pixels on the LCD panel 12 in both the dot matrix display portion 14 and the icon display portion 16 have enough power to turn ON (i.e. nonblank) in high-multiplex mode.

Figure 2:
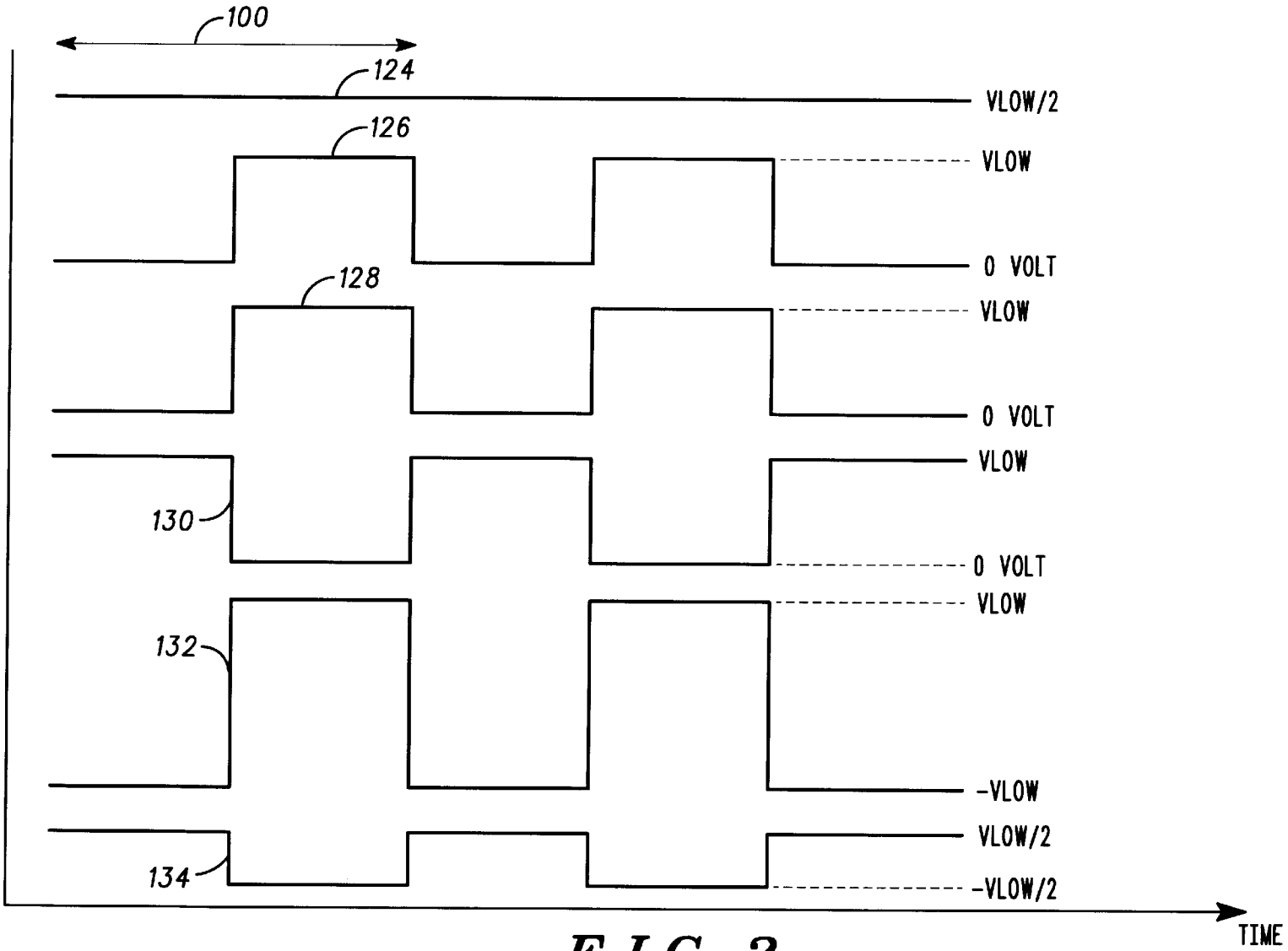
FIG. 2 is a waveform diagram showing the waveform set for both row and column drivers in one mode of operation of the system of FIG. 1.

To save power when only information in the icon display portion 16 of the LCD panel 12 is required, and thus switch to low-multiplex mode, the MCU 24 sends a command to the LCD driver system 10 via line 26 to enter the low-multiplex mode. The command decoder 28 converts the command signal to a disable signal at a high logical "1" voltage level, which is communicated via line 30 to disable the display counter 32, via line 40 to disable the row decoder 38 and via line 84 to disable the RAM row decoder 64. However, since the disable signal passes through the OR gate 56 at the input of icon row driver portion 54 of the row driver device 50, this row driver portion 54 will always output the selected voltage waveform 126, as shown in FIG. 2. However, because the row decoder 38 is disabled, the dot matrix row driver portion 52 of the row driver device 50 will always output the unselected voltage level 124, shown in FIG. 2.

Similarly, because the RAM row decoder 64 is disabled, but the disable signal is applied to one input of the OR gate 82, only the bottom row of the RAM 76, which stores the bitmap data for the icon display portion 16 of LCD panel 12, will be selected and read by the display data buffer 80. The column driver 88 will thus output a blank column waveform 128 and a nonblank column waveform 130 according to the data held by the display data buffer 80.

At the same time, the power source 58 is switched to output low voltages on the row power lines 60 and the column power lines 90, by the disable signal received by the power source 58 via line 66. Selecting low voltage reduces the power consumption of the LCD driver 10 even more. The icon display portion 16 will still operate when the power source 58 is switched to supply only low voltage because of a special waveform set for the row driver 50 and column driver 88 in low-multiplex mode. As shown in FIG. 2, the unselected row waveform 124 is actually a steady voltage level at a level approximately half of $V_{LOW}$, while the selected row waveform 126 is a square wave extending from 0 volt to $V_{LOW}$. The blank column waveform 128 is the same as the selected row waveform 126, while the nonblank column waveform 130 is also a square wave but is completely out of phase with the blank column waveform 128. Thus, the pixel voltage for the selected row in a nonblank column is twice $V_{LOW}$, as shown by waveform 132, which will be higher than the threshold voltage of the LCD panel, whereas the pixel voltage of the unselected rows, even in a nonblank column, will be the difference between $V_{LOW}/2$ and minus $V_{LOW}/2$, which is just $V_{LOW}$, as shown by waveform 134, which is less than the threshold voltage of the LCD panel.

By providing such a set of waveforms, the pulse width of the row corresponding to the icon display portion 16 covers the whole time frame rather than only a small portion of the time frame as in the high-multiplex mode, since in the low-multiplex mode it always has only one active row (the icon row) instead of N active rows in one time frame, as occurs in high-multiplex mode. Thus the difference between the selected row voltage level 126 and the nonblank column voltage level 130 by a factor of square root of N, is always greater than the threshold voltage of the LCD panel, so that the icon display portion 16 will be operable even when the power source 58 only supplies low voltages.

It will be appreciated that although only one particular embodiment of the invention has been described in detail, various modifications and improvements can be made by a person skilled in the art without departing from the scope of the present invention.

We claim:

1. A Liquid Crystal Display (LCD) driver system for driving an LCD having a dot matrix display portion and an icon display portion, the LCD driver system comprising:

an LCD including a dot matrix display portion having a plurality of display rows and an icon display portion having at least one display row;

a row driver coupled to the display rows of the LCD for driving the display rows;

a voltage supply for selectively supplying either a higher or lower voltage level to the row driver;

a row decoder coupled to the row driver for selectively enabling the display rows of the dot matrix display portion and of the icon display portion;

a controller for providing a mode signal indicating either a normal mode of operation or an icon mode of operation;

whereby the mode signal is coupled to the voltage supply for supplying the lower voltage level when the mode signal indicates the icon mode of operation and the higher voltage level when the mode signal indicates the normal mode of operation;

the mode signal also being coupled to the row decoder for enabling the display rows of the dot matrix display portion when the mode signal indicates the normal mode of operation and disabling the display rows of the dot matrix display portion when the mode signal indicates the icon mode of operation;

the display row of the icon display portion being enabled when the mode signal indicates the icon mode of operation and being selectively enabled by the row decoder when the mode signal indicates the normal mode of operation.

2. An LCD driver system according to claim 1, further comprising:

a column driver coupled to display columns of the LCD for driving the display columns and to the voltage supply;

a memory having a plurality of memory rows for storing a representation of information to be displayed on the dot matrix display portion and the icon display portion of the LCD, the memory being coupled to the column driver;

a memory row decoder coupled to the memory for selectively enabling the memory rows of the memory; wherein the mode signal is coupled to the memory row decoder for enabling the memory rows storing the representation of information to be displayed on the dot matrix portion of the LCD when the mode signal indicates the normal mode of operation and disabling the memory rows storing the representation of information to be displayed on the dot matrix portion of the LCD when the mode signal indicates the icon mode of operation.

3. A Liquid Crystal Display (LCD) driver system for driving an LCD having a dot matrix display portion and an icon display portion, the LCD driver system comprising:

an LCD including a dot matrix display portion having a plurality of display rows and an icon display portion having at least one display row;

a row driver coupled to the display rows of the LCD for driving the display rows;

a voltage supply for selectively supplying either a higher or lower voltage level to the row driver;

a row decoder coupled to the row driver for selectively enabling the display rows of the dot matrix display portion and of the icon display portion;

a controller for providing a mode signal indicating either a normal mode of operation or an icon mode of operation;

whereby the mode signal is coupled to the voltage supply for supplying the lower voltage level when the mode signal indicates the icon mode of operation and the higher voltage level when the mode signal indicates the normal mode of operation;

the mode signal also being coupled to the row decoder for enabling the display rows of the dot matrix display portion when the mode signal indicates the normal mode of operation and disabling the display rows of the dot matrix display portion when the mode signal indicates the icon mode of operation;

the display row of the icon display portion being enabled when the mode signal indicates the icon mode of operation and being selectively enabled by the row decoder when the mode signal indicates the normal mode of operation;

a column driver coupled to display columns of the LCD for driving the display columns and to the voltage supply;

a memory having a plurality of memory rows for storing a representation of information to be displayed on the dot matrix display portion and the icon display portion of the LCD, the memory being coupled to the column driver;

a memory row decoder coupled to the memory for selectively enabling the memory rows of the memory;

wherein the mode signal is coupled to the memory row decoder for enabling the memory rows storing the representation of information to be displayed on the dot matrix portion of the LCD when the mode signal indicates the normal mode of operation and disabling the memory rows storing the representation of information to be displayed on the dot matrix portion of the LCD when the mode signal indicates the icon mode of operation, wherein during the icon mode of operation:

the row driver outputs a square wave signal to the display row of the icon display portion of the LCD, the square wave signal having a lower level at a ground reference potential and a higher level at the lower voltage level, and a substantially static voltage signal to the display rows of the dot matrix display portion, the static voltage signal being at a level substantially halfway between the ground reference potential and the lower voltage level; and the column driver outputs a first square wave signal, in phase with the square wave signal output from the row driver, to display the columns of the LCD which are to remain blank, the first square wave signal from the column driver having a lower level at a ground reference potential and a higher level at the lower voltage level, and a second square wave signal, complementary to the first square wave signal, to the display columns of the LCD which are to be non-blank, the voltage difference between the column driver output signal and the row driver output signal controlling whether a particular pixel is blank or non-blank according to whether the voltage difference is higher than the threshold voltage required to activate the pixel, so that the display rows of the dot matrix display portion are disabled.

* * * * *